US005292994A

United States Patent [19]

Kobayashi et al.

[11] Patent Number: 5,292,994

[45] Date of Patent: Mar. 8, 1994

[54] TONE SETTING SYSTEM FOR ELECTRONIC MUSICAL INSTRUMENT

[75] Inventors: Ikuo Kobayashi; Toshihide Saito, both of Shizuoka, Japan

[73] Assignee: Kabushiki Kaisha Kawai Gakki Seisakusho, Hamamatsu, Japan

[21] Appl. No.: 997,626

[22] Filed: Dec. 28, 1992

Related U.S. Application Data

[63] Continuation of Ser. No. 787,743, Nov. 4, 1991, abandoned, which is a continuation of Ser. No. 584,838, Sep. 19, 1990, abandoned.

[30] Foreign Application Priority Data

Sep. 26, 1989 [JP] Japan ..... 1-249776

[51] Int. Cl.[5] ..... G10H 1/18

[52] U.S. Cl. ..... 84/602; 84/615; 84/653

[58] Field of Search ..... 84/600-602, 84/615, 617, 618, 653, 655, 656

[56] References Cited

U.S. PATENT DOCUMENTS 4,817,484 4/1989 Iba et al. ..... 84/DIG. 12

4,947,724 8/1990 Hirano et al. ..... 84/631

*Primary Examiner*—William M. Shoop, Jr.

*Assistant Examiner*—Brian Sircus

*Attorney, Agent, or Firm*—Sughrue, Mion, Zinn, Macpeak & Seas

[57] ABSTRACT

A tone setting device for an electronic musical instrument includes a tone signal generator for generating a tone signal by operating a plurality of tone setting switches, a detection circuit for detecting particular tone setting switches operated for a tone setting and a sequence of operations of the particular tone setting switches and an operation control device for controlling an operation of the detection circuit. The tone setting device makes a setting of any of a number of tones possible with minimum number of operations of the tone setting switches.

1 Claim, 5 Drawing Sheets

TONE SETTING SYSTEM FOR ELECTRONIC MUSICAL INSTRUMENT

This is a continuation of U.S. patent application Ser. No. 07/787,743 filed Nov. 4, 1991, now abandoned which is a continuation of U.S. patent application Ser. No. 07/584,838 filed Sept. 19, 1990, now abandoned.

BACKGROUND OF THE INVENTION

A tone setting in a conventional electronic musical instrument for adapting the latter to a specific instrument such as a piano or organ has been performed by either of two schemes shown in FIGS. 5 and 6, respectively. According to the first scheme shown in FIG. 5 which illustrates a portion of an electronic piano panel including a plurality of tone setting switches 1-1 to 1-8 and a corresponding, number of light emitting diodes 2-1 to 2-8, one of the setting switches which corresponds to a desired instrument, is turned on. When a tone of piano 1 is to be obtained, the switch 1-1 is turned on upon which the corresponding light emitting diode 2-1 is activated. Alternatively, when it is desired to obtain the tone of a harpsichord, the switch 1-6 is turned on. An output signal corresponding to a switch thus turned on is supplied to a tone generator (not shown) to produce a desired tone signal.

In the second scheme shown in FIG. 6, each of the tone setting switches 1-9 to 1-13 corresponding to different types of instrument is associated with a plurality of light emitting diodes 2-9 to 2-12 corresponding to individual instruments belonging to each instrument type. When the switch 1-9 is turned on once, the light emitting diode 2-9 is activated and a string instrument is set. In this case, a pulse is generated which is counted by a pulse counter which is reset every five counts and whose output is supplied to a tone generator. By depressing the switch 1-9 again, the light emitting diode 2-9 is extinguished and instead thereof light emitting diode 2-10 is lit, showing a setting of a flute tone, and the pulse counter supplies its output of two counts to the tone generator. Thereafter, when the switch 1-13 is depressed to turn it on, the light emitting diode 2-9 is lit, indicating a guiter set. In this case, an output is sent to the counter corresponding to the switch 1-9 to reset the latter and to a counter corresponding thereto to count one which is sent to the tone generator. That is, in FIG. 6, any of the switches 1-9 to 1-10 is depressed repeatingly until a desired tone in tones belonging to the depressed switch is set.

In either of the cases shown in FIGS. 5 and 6, the operation of any switch or the number of operations of any switch, energization and deenergization of light emitting diodes and signal output to the tone generator can be processed by a micro processor.

The tone setting in such a conventional electronic musical instrument in which a plurality of switches together with light emitting diodes are arranged in a plane is satisfactory when the number of tones is limited. However, with the recent tendency of an increased number, say, one hundred, different tones, it becomes difficult to arrange a number of switches and associated light emitting diodes in a plane. For example, in the system shown in FIG. 5, in order to arrange 100 switches, a panel area therefor becomes very large providing no space for associated light emitting diodes. In order to realize 100 tones in the example shown in FIG. 6, it may be considered to provide 12 switches to each of which 8 light emitting diodes are allocated. In such a case, however, any one of the switches must be depressed 8 times when an immediately preceding tone is to be selected. This is not practical. Further, when the number of switches is to be reduced for some reason, the number of light emitting diodes for each switch must be increased, resulting in a further increase of depressing times of each switch.

SUMMARY OF THE INVENTION

An object of the present invention is to solve the above mentioned problem by providing a device capable of setting any of a large number of tones easily and quickly according to an operation sequence of a limited number of tone setting switches.

According to the present invention, the device comprises a plurality of tone setting switches 11, a detection circuit 12 for detecting any of the switches operated and a sequence of the operations, an operation control device 13 for controlling an operation of the detection circuit 12, a tone signal generator 14 and a sound system 15. An output of the detection circuit 12 is supplied to the tone signal generator 14 under control of the operation control device 13 to generate a predetermined tone signal upon which the sound system 15 produces a predetermined tone.

DETAILED DESCRIPTION OF THE PREFERRED EMBODIMENT

Figure 1:
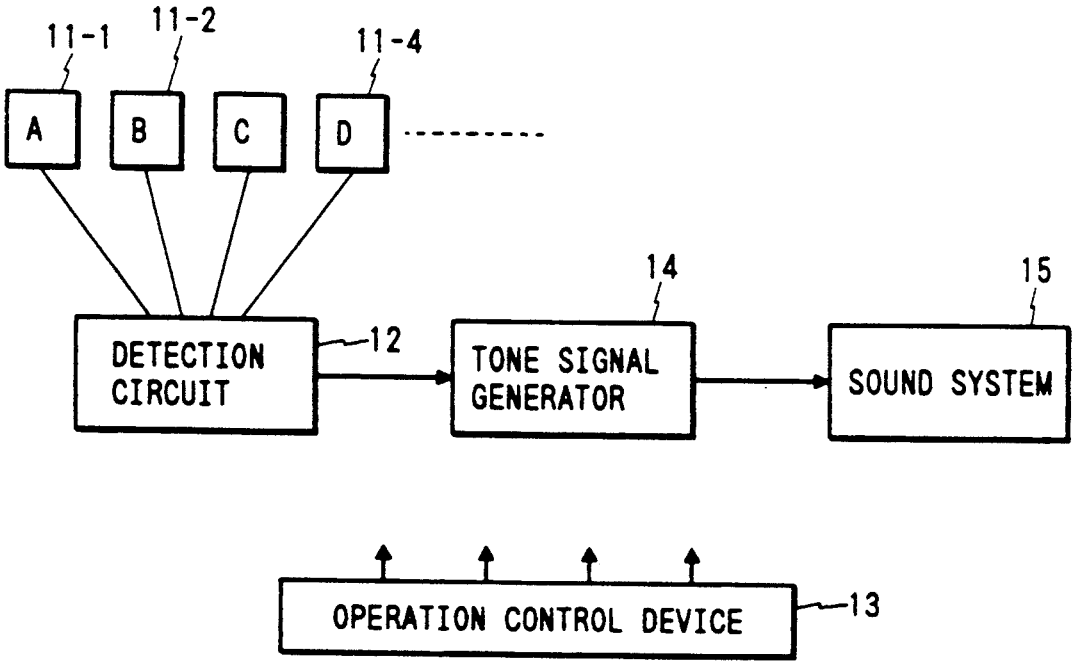
FIG. 1 shows a basic construction of the present invention.

In FIG. 1, a plurality of tone setting pad switches 11 are provided. For simplicity purpose, four tone setting pad switches are shown as indicated by reference capitals A, B, C and D although the number of the tone setting pad switches is not limited thereto. A sequence of operation of these pad switches is detected by a detection circuit 12 under control of an operation control device 13. For example, the operation sequence of the switches B, A, B and A may be allocated to, for example, oboe tone. Thus, when the switch operation sequence B, A, B and A is detected by the detection circuit 12, the sequence is decoded according to the allocation and a resultant signal is sent to a tone signal generator 14 under control of the operation control device 13. The tone signal generator 14 responds thereto to generate a tone signal upon which a sound system 15 produces oboe tone. These operations are performed under control of the control device 13.

In the case shown in FIG. 1 in which the switches A, B, C and D are provided, the number of producible tones each represented by a sequence of four switches becomes 256 ($=4\times4\times4\times4$).

Figure 2:
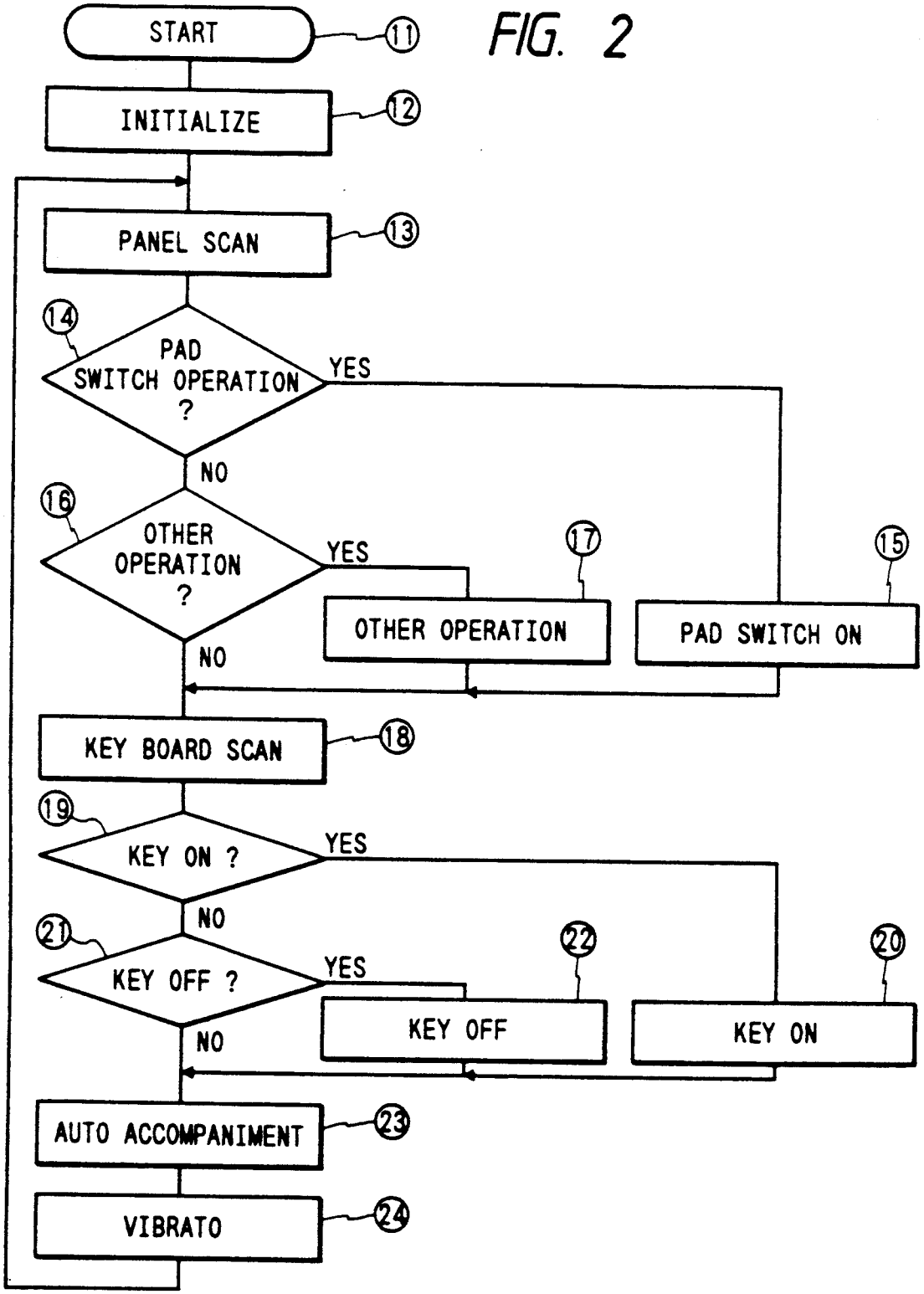
FIG. 2 is a flow chart showing an operation of a control device shown in FIG. 1.
Figure 3:
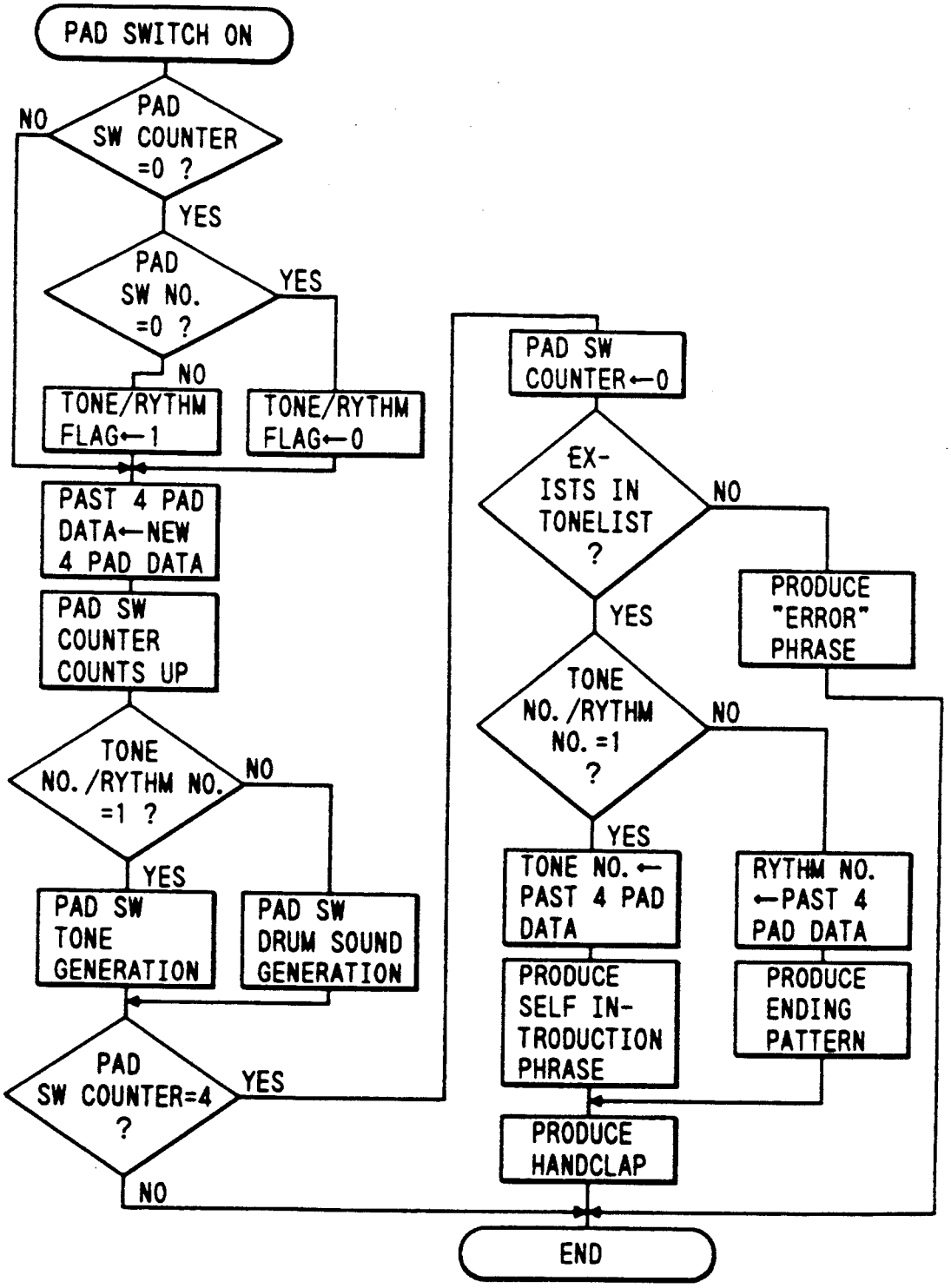
FIG. 3 is a detailed flow chart of a portion of the flow chart in FIG. 2.

An operation of the detection circuit 12 in FIG. 1 is performed according to a software of the operation control device 13. An example of flow chart thereof is shown in FIG. 2. FIG. 3 shows the step 15 in FIG. 2, i.e., a process in which pad switches are depressed, in more detail and FIG. 4 shows the step 20 in FIG. 2, i.e., a cancelling processing which is independent from the tone setting and in which key board is utilized, in more detail.

In the flow chart shown in FIG. 2, the steps 13 to 24 are repeated at high speed. Since this main loop of the flow chart runs cyclically from a time when the first pad switch is depressed to a time at which a subsequent pad switch is depressed, a pad switch counter for counting the number of depressions of the pad switches and a register for storing an information of four, last depressed pad switches are provided, which can be up dated. In order to identify pad depressed, the pad switches A, B, C and D are, for example, numbered as 1, 2, 3 and 4, respectively, and the register has a width of 8-bits so that the old information of the pad switches depressed in the past, shown in FIG. 3, is erased by a subsequent depressions of four pad switches, updating the information stored. Further, the content of the pad switch counter, at such time, indicates 4, on which it is possible to set a new desired tone. Therefore, the new four, last depressed pad switches information is set in the tone signal generator as a tone setting number and the pad switch counter is reset to 0. When the tone number set in this manner is in a preset tone list, a self introduction phrase corresponding to the set tone is produced followed by sound of handclap. If a tone which does not exist in the tone list is set or if a setting is cancelled during processing, an error phrase (or booing) is produced.

In FIG. 3, when a setting of the pad counter exists in the tone list, a self-introduction phrase corresponding to the tone is outputted, followed by sound of handclap. In FIG. 4, if a tone which does not exist in the tone list is set or when a setting is to be cancelled during processing, an error phrase (or booing) is provided.

Figure 4:
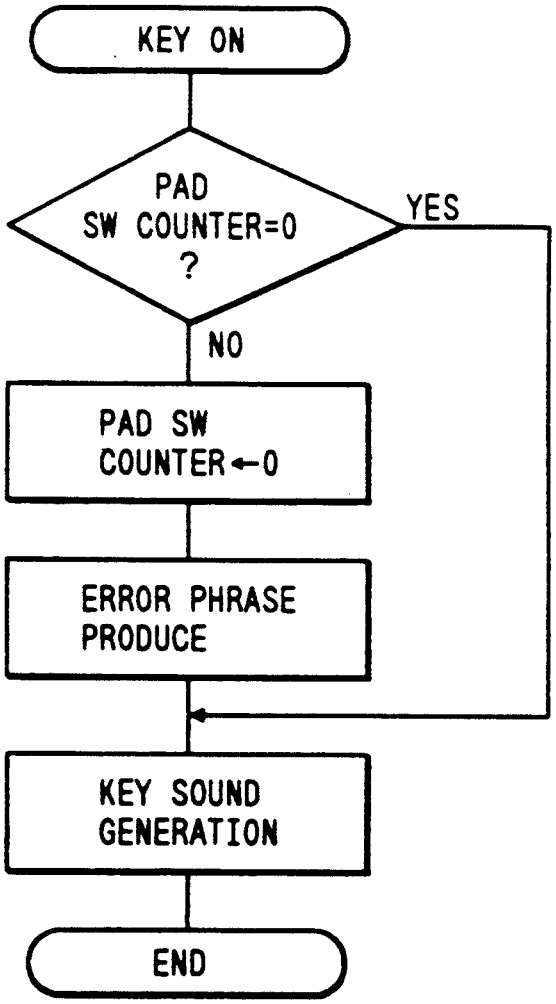
FIG. 4 is a detailed flow chart of another portion of the flow chart in FIG. 2.
Figure 5:
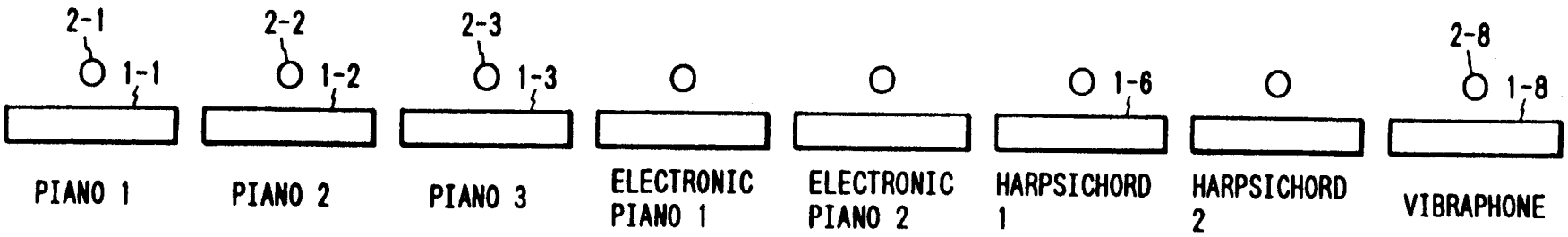
FIG. 5 illustrates an arrangement of tone setting switches in a conventional electronic piano panel.
Figure 6:
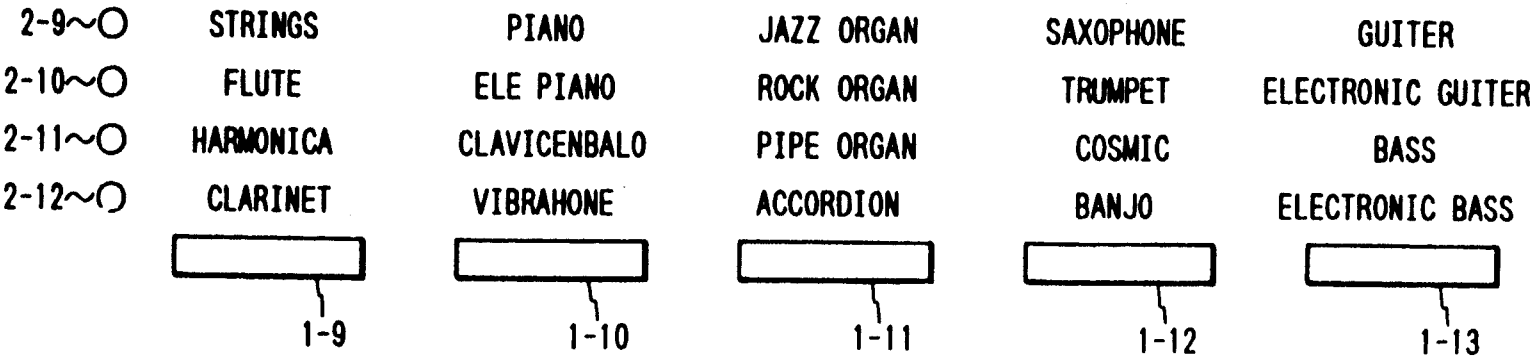
FIG. 6 illustrates an arrangement of tone setting switches in another conventional electronic piano panel.

As shown in FIG. 4, depression of a key during tone setting in which the pad switch counter has a value other than 0 means that the tone selection is cancelled. Therefore, the error phrase is provided.

Since, when four pad switches are provided as mentioned, 256 settings are available, there may be too many settings. In such case, it is possible to allocate some of them to rhythm settings. When a rhythm is set, it is preferable to produce an ending pattern of the set rhythm as the self-introduction.

What is claimed is:

1. A tone setting device for use in an electronic musical instrument, comprising:

a plurality of tone setting switches;

a detection circuit for detecting certain switches of said tone setting switches, which are operated to set a certain tone, and an operating sequence of said certain switches;

an operation control device for controlling an operation of said detection circuit;

a tone signal generator responsive to an output of said detection circuit to generate a tone signal under control of said operation control device;

a sound system responsive to said tone signal for said tone signal generator to generate sound corresponding thereto; and a signal generator circuit included in said detection circuit for generating a tone setting completion signal when a tone setting is completed, said signal generator circuit being adapted to send said tone setting completion signal to said tone signal generator, to cause said tone signal generator to generate different phases preliminarily prepared for cases when said tone setting is correct and not correct, respectively.

* * * * *